United States Patent [19]

Rampe

[11] 4,090,332

[45] May 23, 1978

[54] SUSPENSION SYSTEM FOR BOWL-TYPE VIBRATORY FINISHING MACHINE

[75] Inventor: John F. Rampe, Mayfield Heights, Ohio

[73] Assignee: Rampe Research, Cleveland, Ohio

[21] Appl. No.: 720,212

[22] Filed: Sep. 3, 1976

Related U.S. Application Data

[63] Continuation-in-part of Ser. No. 714,823, Aug. 16, 1976.

[51] Int. Cl.[2] ..... B24B 31/06

[52] U.S. Cl. ..... 51/163.2

[58] Field of Search ..... 51/163.1, 163.2

[56] References Cited

U.S. PATENT DOCUMENTS

| | | | |
|---|---|---|---|
| 3,449,869 | 6/1969 | Rampe | 51/163.1 |
| 3,708,918 | 1/1973 | Pool | 51/163.2 |
| 3,877,178 | 4/1975 | Campanelli | 51/163.2 |
| 3,991,524 | 11/1976 | Ferrara | 51/163.1 |

FOREIGN PATENT DOCUMENTS

| | | | |
|---|---|---|---|
| 1,652,154 | 5/1970 | Germany | 51/163.2 |

*Primary Examiner*—Harold D. Whitehead
*Attorney, Agent, or Firm*—David A. Burge Co.

[57] ABSTRACT

A vibratory finishing machine has a bowl structure supported by shear-loaded elastomeric mounts, and a drive system for vibrating the bowl structure about a node or null point located along a vertical center axis of the bowl structure. Each of the elastomeric mounts has one portion secured to the bowl structure, and another portion secured to a base structure. The one and another portions define an axis of each mount. Certain of the mounts are arranged such that their axes intersect the center axis above the node or null point. Others of the mounts are arranged such that their axes intersect the center axis below the node or null point. Mounts arranged as described stabilize the location of the node or null point and thereby render the machine less sensitive to variations in bowl loading.

22 Claims, 4 Drawing Figures

SUSPENSION SYSTEM FOR BOWL-TYPE VIBRATORY FINISHING MACHINE

REFERENCE TO RELATED AND RELEVANT PATENTS

The present application is a continuation-in-part of application Ser. No. 714,823, filed Aug. 16, 1976 and entitled Bowl-Type Vibratory Finishing Machine, here the "Bowl Machine Patent", the disclosure of which is incorporated by reference.

Molded Plastic Pulley With Heat Conducting Metal Lining, U.S. Pat. No. 3,142,997 issued Aug. 4, 1964 to J. F. Rampe, here the "Pulley Patent".

BACKGROUND OF THE INVENTION

1. Field of the Invention

The present invention relates generally to vibratory finishing machines, and more particularly to a novel and improved bowl-type vibratory finishing machine.

2. Prior Art

Many surface finishing operations such as deburring, burnishing, descaling, cleaning and the like can be conducted expeditiously in a vibratory finishing machine. Such a machine includes a movably mounted receptacle and a drive system for vibrating the receptacle. Workpieces to be finished are loaded into the receptacle together with finishing media. A finishing action is imparted to the workpieces by vibrating the receptacle so that the mixture of workpieces and media is effectively maintained in a fluid or mobile state with smaller components of the mixture dispersed between large components for impact. Impulse forces imparted to the mixture not only cause repeated impacts among its components but also cause the mixture to churn in a predictable manner as a finishing process is carried out.

Two basic types of vibratory finishing machines are in common use. One type employs an elongated, substantially horizontally disposed receptacle which is vibrated by eccentrics rotating about horizontal axes paralleling the length of the receptacle. This first type of machine is known in the art as a "tub-type mchine" or simply "tub machine", and its receptacle is commonly called a "tub". Another type uses a substantially annular receptacle which is vibrated by rotating one or more eccentrics about a vertical "center axis" located centrally of the receptacle when the receptacle is at rest. This latter type of machine is known in the art as a "bowl-type machine" or simply "bowl machine", and its receptacle is commonly called a "bowl". While tub and bowl machines have many similar characteristics, they are sufficiently different in arrangement and operation that one will frequently offer advantages over the other in solving a particular finishing problem. The present invention relates to bowl-type machines.

During operation of a bowl machine, the bowl vibrates in gyratory movements about a node or null point located somewhere along the machine's center axis. This gyratory movement subjects the bowl's contents to a complex of vertical, radial and tangential impulse components which are intended to effect a uniform dispersion of the smaller components of the workpiece and media mixture among the large components of the mixture for impact. The resultant impulses are so oriented and timed as to cause both circumferential precession of the mixture and rotation of the mixture in essentially radiating vertical planes.

Those skilled in the art maintain different and conflicting theories on where the node or null point should be located along the center axis. Some maintain that the node or null point should be located within or near a horizontal plane which includes the center of gravity of the bowl's contents. This arrangement effectively minimizes horizontal impulse components imparted to the bowl's contents and maximizes the vertical components. Others maintain that a node or null point location slightly below the bottom of the bowl's chamber is desirable since it gives something of a mix of vertical, horizontal and tangential components. Still others advocate higher and lower node or null point locations.

Those skilled in the art similarly advance different and conflicting theories on the number of eccentrics which should be used to vibrate the bowl, the locations of the eccentrics, and the relative orientations of the eccentrics where more than one is used. Still other theories obtain on how and where a drive motor should connect with the eccentrics.

Factors such as node or null point location, the number, location and arrangement of eccentrics, and features of the drive motor connection all intertwine to determine such other factors as:

a. the simplicity or complexity of the machine;

b. the ease with which the machine can be serviced and such parts as bearings replaced;

c. the longevity of service which can be expected from the machine;

d. the sensitivity of the machine to different bowl loadings, i.e., whether it can handle a wide range of large and small, heavy and light loads; and e. the type of vibratory movement which is imparted to the bowl, which, in turn, determines such things as:

i. the type of circulation movement which will be executed by a mixture of media and workpieces in the bowl;

ii. the direction and rate of precession of the mixture; and iii. the effectiveness of the resulting finishing action in terms of quality and time required to carry it out.

Previous proposals made in an effort to optimize these factors have resulted in machines which are relatively complex and difficult to service. The need for frequent bearing replacement has been a continuing problem, and the construction of many such machines has made bearing replacement difficult. Most bowl machines are quite sensitive to changes in bowl loading and operate effectively only in a relatively narrow loading range.

The invention described in the referenced Bowl Machine Patent addresses the foregoing and other problems of the prior art. It provides a bowl-type machine having a combination of features that are unique to the industry. The machine is of simple, relatively inexpensive construction. It has a relatively simple but rugged base structure, an equally simple and rugged bowl structure, and utilizes highly durable elastomeric mounts to support the bowl structure on the base structure.

A significant feature of the invention described in the Bowl Machine Patent lies in its novel arrangement of elastomeric mounts. Each mount has one portion secured to the base structure and another portion secured to the bowl structure. The one and another portions define an axis for each mount, and the mounts are arranged such that their axes intersect at a common point along the machine's center axis. The machine's drive system is arranged to vibrate the tub about a node or null point which coincides with this common point. The arrangement of mounts assures that forces imposed on the mounts by movements of the bowl structure load the mounts in shear, i.e., in planes normal to their axes. When arranged and loaded in this manner, the mounts tend to resiliently oppose movements of the bowl structure in any mode other than about the desired node or null point. As a result, the machine is found to be substantially less sensitive to variations in receptacle loading than are other, previously proposed bowl-type machines. A single machine can, for example, handle bowl load volumes within as large a range as 2 cubic feet to 6 cubic feet, and is operable to impart a good finishing action to the load anywhere within this very broad range.

Bowl machine proposals prior to the invention described in the referenced Bowl Machine Patent do not address the problem of stabilizing actual node or null point location. It is believed that the tendency of node or null point location to vary with changes in bowl loading explains, at least in part, the difficulty prior proposals have encountered in providing machines that will handle a wide range of bowl loadings. If the actual location of the node or null point about which a bowl structure moves is displaced from the location for which the machine was designed, the machine operates inefficiently, if at all, and causes excessive wearing of drive and suspension system components.

SUMMARY OF THE INVENTION

The present invention provides a novel and improved suspension system for bowl-type vibratory finishing machines.

The invention described in the referenced Bowl Machine Patent and the present invention have several features in common. Both utilize an arrangement of elastomeric mounts to stabilize null point location and to thereby reduce the sensitivity of the machine to variation in bowl loading. Both inventions utilize mounts which are loaded principally in shear by the dead weight of the bowl structure and its contents.

The inventions differ in their arrangement of mounts and the resulting loadings which are imposed on the mounts as their bowl structures move about their null points. Whereas the invention of the referenced Bowl Machine Patent addresses the problem of null point stability by providing an arrangement of elastomeric mounts having axes which intersect the machine's center axis at the desired null point location, the present invention provides even greater null point stability by using some mounts with axes which intersect the machine's center axis above the desired null point, and other mounts with axes which intersect the machine's center axis below the desired null point. Whereas the invention described in the referenced Bowl Machine Patent utilizes mounts loaded substantially solely in shear by vibratory movements of the bowl structure, the present invention utilizes mounts which are subjected to a degree of tensile and compressive loadings in a way which enhances null point stability.

In preferred practice, null point stability is enhanced through the use of upper and lower groups of mounts. The upper mounts have axes which extend in a first horizontal plane and intersect the machine's central axis a short distance "H" above the null point. The lower mounts have axes which extend in a second horizontal plane and intersect the machine's central axis at the distance "H" below the null point. The same number of mounts are preferably included in each of the upper and lower groups, and each upper mount is preferably positioned in a vertically stacked arrangement directly above a separate one of the lower mounts. All of the mounts are preferably located at a common radial distance "R" from the machine's center axis.

The relationship of the "H" and "R" dimensions is selected such that while the mounts are loaded principally in shear by movements of the bowl structure, the mounts experience a degree of axial tension and compression. Inasmuch as the mounts oppose bowl structure movements which tend to axially strain the mounts, and inasmuch as movements of the bowl structure about the null point minimize axial mount strains, the mounts oppose movements of the bowl structure about any null points other than the null point.

As the bowl structure moves about the null point, each vertically stacked pair of upper and lower mounts will be cyclically axially loaded first with the upper mount in tension and the lower mount in compression, and then with the upper mount in compression and the lower mount in tension. The resistance offers by the mounts to axial extensions and compressions maintains the node point at a vertical location between the plane of the upper mount axes and the plane of the lower mount axes.

The described preferred arrangement of suspension system mounts can be used in combination with additional mounts having axes which intersect at the null point. Where such auxiliary mounts are used, the fact that their axes intersect at the null point assures that movements of the bowl structure about the null point will load the auxiliary mounts substantially solely in shear, whereby the chore of maintaining null point stability is left largely to the upper and lower mounts.

It is "unexpected", to say the least, that significant advantages in machine operating characteristics should result from the described relatively unorthodox arrangement of suspension system mounts. One would tend to think that all mount axes must necessarily intersect at the machine's null point for the machine to be operable. The present invention dispells this misconception and provides a novel approach to the problem of rendering a bowl-type vibratory finishing machine less sensitive to variations in bowl loading.

As will be apparent to those skilled in the art, once the concept of stabilizing null point location by utilizing the relative axial incompressibility and inextensibility of elastomeric mounts is recognized, a wide variety of mount arrangements utilizing this concept suggest themselves. Preferred arrangements are those wherein the mounts are subjected principally to shear loading by the dead weight of the bowl structure and its contents.

It is a general object of the present invention to provide a novel and improved bowl-type vibratory finishing machine.

It is another object to provide a bowl-type vibratory finishing machine having an improved suspension system.

It is still another object to provide a bowl-type finishing machine which is relatively insensitive to variations in bowl loading.

These and other objects and a fuller understanding of the invention described and claimed in the present application may be had by referring to the following description and claims taken in conjunction with the accompanying drawings.

DESCRIPTION OF THE PREFERRED EMBODIMENT

Figure 1:
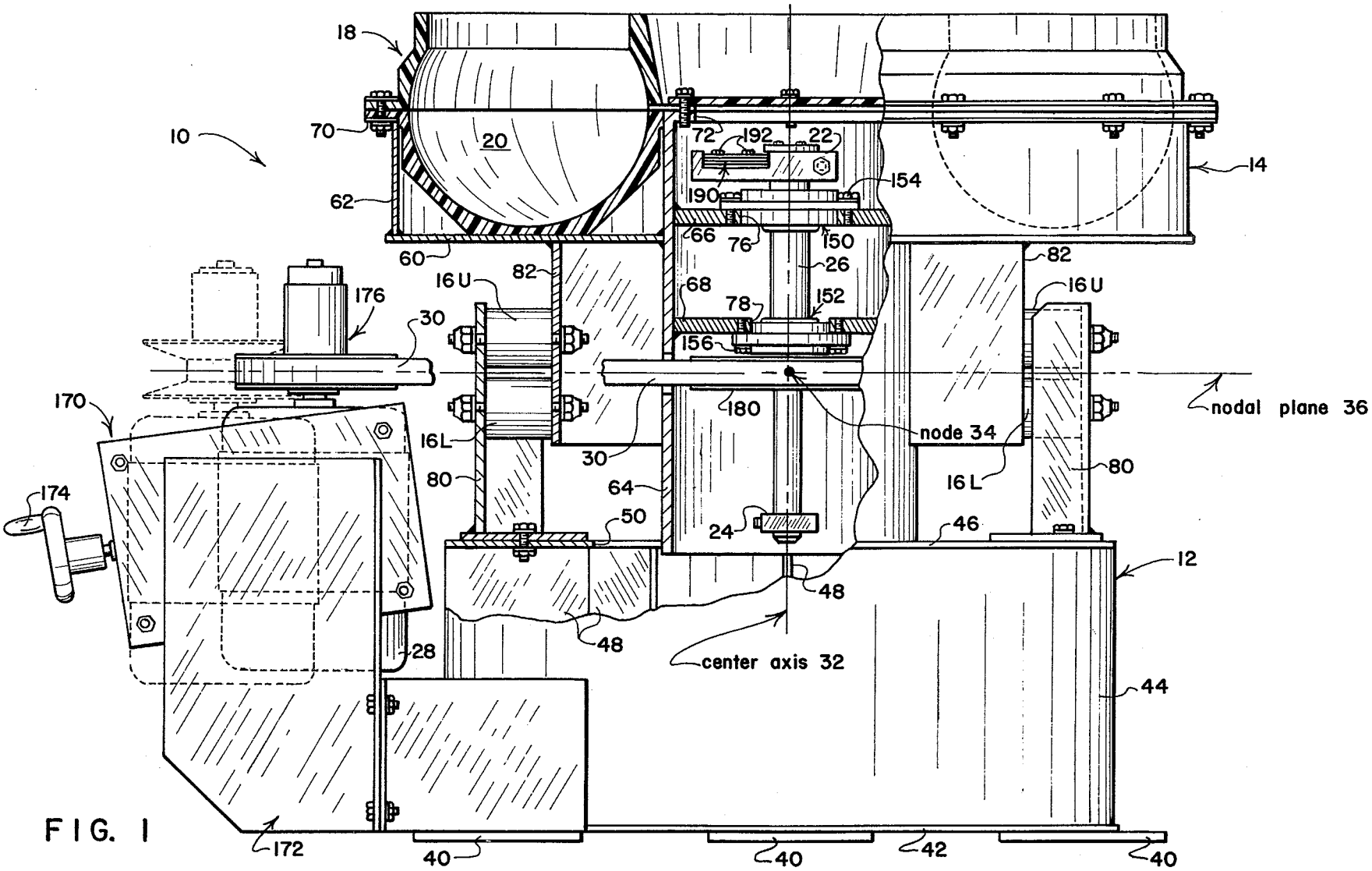
FIG. 1 is a side elevational view of a bowl-type vibratory finishing machine including one suspension system embodiment, the view having portions broken away and shown in cross-section, and showing in phantom one extreme position of a drive motor and variable speed pulley.
Figure 2:
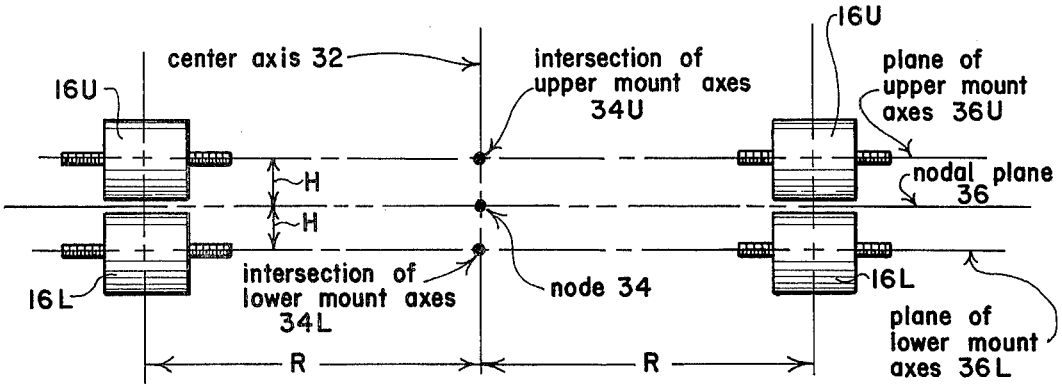
FIG. 2 is a schematic illustration of the suspension system employed in the machine of FIG. 1.

Referring to FIGS. 1 and 2, a vibratory finishing machine is indicated generally by the numeral 10. The machine 10 includes a base structure 12 and a bowl structure 14. Upper and lower sets of elastomeric mounts 16U, 16L resiliently interconnect the structures 12, 14 and permit relative movement therebetween. A replaceable liner assembly 18 forms part of the bowl structure 14 and defines an annular finishing chamber 20 for receiving media and workpieces to be finished. Vibratory movements are imparted to the bowl structure 14 by a drive system which includes a pair of eccentric weights 22, 24 supported on opposite ends of a rotatable shaft 26, a motor 28, and a belt 30 which drivingly interconnects the shaft 26 and the motor 28. The machine 10 is identical to the machine described in the referenced Bowl Machine Patent except for its arrangement of mounts 16U, 16L. The machine 10 has a "center axis", indicated by the numeral 32. The center axis 32 is an imaginary vertical line defined by the axis of the shaft 26 when the machine 10 is at rest. The center axis 32 extends substantially coaxially of the trough or chamber 20. During operation of the machine 10, the bowl structure 14 vibrates substantially about a node or null point 34. The node 34 is located at the juncture of the center axis 32 and a horizontally extending "nodal plane" 36. As will be appreciated by those skilled in the art, in actual practice the node or null point 34 is not a mathematical point but rather should be considered to be a small region around the juncture of the center axis 32 and the nodal plane 36. Depending on such variables as the position of the center of gravity of the bowl structure 14 and its contents, the node or null point 34 may be located a small distance above or below the nodal plane 36. Due to a number of factors including the fact that the bowl structure 14 need not be accurately balanced, the actual node or null point 34 may oscillate through small distances about the juncture of the center axis 32 and the nodal plane 36. As will be explained, the elastomeric mounts 16U, 16L serve to stabilize the location of the actual node or null point and to maintain it at the intersection of the center axis 32 with the nodal plane 36.

The base structure 12 has a welded framework including four feet 40, a bottom wall 42, a side wall 44, a top wall 46, and bracing plates 48. The feet 40 are welded to the underside of the bottom wall 42 and support the machine 10. The bottom wall 42 is a round plate which is perimetrically welded to the side wall 44. The side wall 44 is cylindrical and extends upwardly from the bottom wall 42. The top wall 46 is of annular configuration, is perimetrically welded to the side wall 44, and has a central opening 50. The bracing plates 48 are welded to the bottom and top walls 42, 46 to rigidify the framework formed by the bottom, side and top walls 42, 44, 46.

The bowl structure 14 has a welded framework including a bottom wall 60, a side wall 62, an upstanding center tube 64, and a pair of bearing mounting plates 66, 68. The bottom wall 60 is of annular configuration and is perimetrically welded to the side wall 62. The side wall 62 is of cylindrical configuration, extends upwardly from the bottom wall 60, and has a peripherally extending rim 70. The center tube 64 extends centrally through and is welded to the bottom wall 60. An inwardly turned rim 72 is formed on the upper end of the center tube, and the lower end of the center tube depends through the base structure opening 50. The bearing mounting plates 66, 68 are of annular configuration, are welded to the center tube 64, and have central openings 76, 78.

The elastomeric mounts 16U, 16L include four upper mounts 16U and four lower mounts 16L. The mounts 16U, 16L are preferably of a type sold by Lord Corporation, Erie, Pennsylvania, 16512, Part Number J5425-4, and have a spring rate of $K_s = 350$ pounds per inch. The mounts 16U, 16L interconnect four pairs of base and bowl structure brackets 80, 82. The mounts 16U, 16L are located symmetrically about the axis of the center tube 64 and overlie alternate ones of the bracing plates 48. The base structure brackets 80 are secured to the top wall 46 at locations above the bracing plates 48. The bowl structure 82 brackets are welded to the center tube 64.

FIG. 2 represents a schematic illustration of the suspension system mount arrangement employed in the machine 10. Referring to FIG. 2, the mounts 16U have axes which lie in a plane 36U above the nodal plane 36 and which intersect the center axis 32 at a point 34U above the node or null point 34. The mounts 16L have axes which lie in a plane 36L below the nodal plane 36 and which intersect the center axis 32 at a point 34L below the node or null point 34. The planes 36U, 36L parallel the nodal plane 36 and are spaced therefrom by a distance H. The mounts 16U, 16L are all located at equal radial distances from the center axis 32, as indicated by the dimensions "R".

Since the axes of the mounts 16U, 16L extend horizontally, the dead weight of the bowl structure 14 and its contents load the mounts 16U, 16L in shear. Since the axes of the mounts 16U, 16L pass quite closely by the node or null point 34, loads imposed on the mounts 16U, 16L by movements of the bowl structure 14 about the node or null point 34 are principally shear loads. But the fact that the mount axes do not pass directly through the node or null point 34 causes the mounts 16U, 16L to experience cylical compressive and tensile strains as the bowl structure 14 moves about the node or null point 34. Inasmuch as the mounts 16U, 16L strongly resiliently oppose being compressed and stretched in axial directions, they tend to confine movements of the bowl structure 14 to a mode where axial compressions and extensions of the mounts 16U, 16L are minimized. Since movements of the bowl structure 14 about the null point 34 minimize axial compressions and extensions of the mounts 16U, 16L, the described arrangement of mounts operates to confine movements of the bowl structure 14 to movements about the null point 34.

Stated in another way, an operating characteristic of the described suspension system is that it stabilizes the location of the actual node or null point about which the bowl structure 14 vibrates. Confining the movements of the bowl structure 14 in this manner is found to significantly reduce the sensitivity of the machine 10 to variations in finishing chamber loading. The operating characteristics of this suspension system are quite unlike previously proposed suspension systems which do little to assist in maintaining a constant node location to reduce sensitivity to variations in finishing chamber loading.

The shaft 26 is journaled by two bearing block assemblies 150, 152. The bearing assembly 150 extends through the mounting plate opening 76 and is secured to the mounting plate 66 by threaded fasteners 154. The bearing assembly 152 extends through the mounting plate opening 78 and is secured to the mounting plate 68 by threaded fasteners 156.

The motor 28 is movably supported by a conventional, adjustable motor mount 170. A bracket assembly 172 supports the motor mount 170 and the base structure 12. The mount 170 has a crank 174 which can be turned to move the motor 28 inwardly and outwardly toward and away from the shaft 26. A variable diameter pulley 176 of the type described in the referenced Pulley Patent is supported on the drive shaft of the motor 28. When the motor 28 is at the inward end of its range of travel, the pulley 176 has a relatively large effective outer diameter, as shown in solid lines in FIG. 1. When the motor 28 is at the outward end of its range of travel, the pulley 176 has a relatively small effective outer diameter, as shown in phantom in FIGS. 1 and 2.

A fixed diameter pulley 180 is secured to the lower end region of the shaft 26. The belt 30 is reeved around and drivingly interconnects the pulleys 176, 180. Depending on the position of the motor 28, the belt 30 is operable to drive the shaft at speeds with the range of about 700 to 1450 revolutions per minute.

A feature of the machine 10 is that the pulleys 176, 180 and the drive belt 30 are located in the nodal plane 36. This arrangement minimizes radial movements of the pulley 180 during machine operation and thereby overcomes problems of excessive belt wear, stretching and failure encounteded in many previously proposed bowl machines.

The eccentric 22 carries a plurality of removable weights 190 which are held in place by threaded fasteners 192. The weights 190 can be added and removed as required to accommodate exceptionally large or small loads of workpieces and finishing media and to adjust the machine for optimal operation within the loading range most commonly used by a particular customer.

Figure 3:
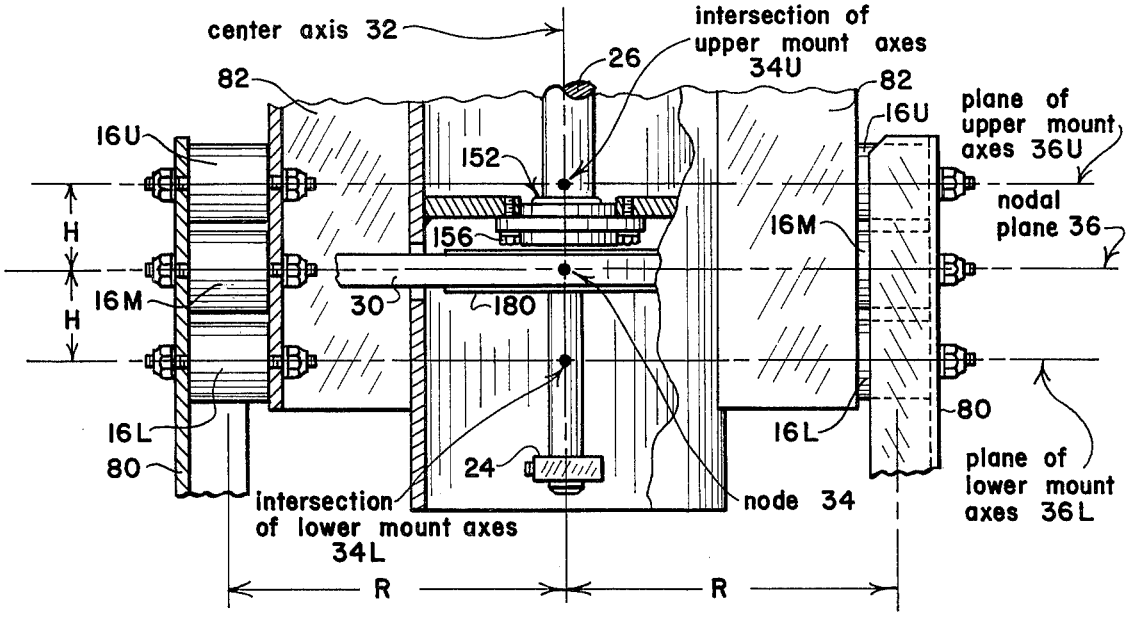
FIG. 3 is a view similar to FIG. 1 of an alternate suspension system embodiment; and, FIG. 4 is a schematic illustration of still another suspension system embodiment.

Referring to FIG. 3, the upper and lower mounts 16U, 16L can be augmented with a third group of mounts 16M. Each of the mounts 16M is located between a separate pair of upper and lower mounts 16U, 16L and has its axis in the nodal plane 36. Since axes of the mounts 16M intersect at the node or null point 34, the mounts 16M are loaded substantially exclusively in shear by movements of the bowl structure 14 about the node or null point 34.

In mount arrangements where the axes of the upper and lower mounts lie in planes which parallel the nodal plane (i.e., the arrangements of FIGS. 1–3), the dimensions H and R must be selected with care to assure that the distance H does not become too large in comparison with the dimension R. A preferred relationship of the dimensions H and R is about $H = 0.12R$. As H is decreased below 0.12R, the null point stabilization effect provided by the upper and lower mounts diminishes because these mounts are subjected to less axial strain as the bowl structure 14 moves about the node or null point 34. As H is increased beyond 0.12R, the magnitude of the null point stabilization effect increases rapidly and requires substantially larger drive system power inputs to vibrate the bowl structure 14. In short, selecting a relationship between the dimensions H and R involves a compromise between the desirability of stabilizing null point location, and the desirability of keeping power input requirements minimal.

Figure 4:
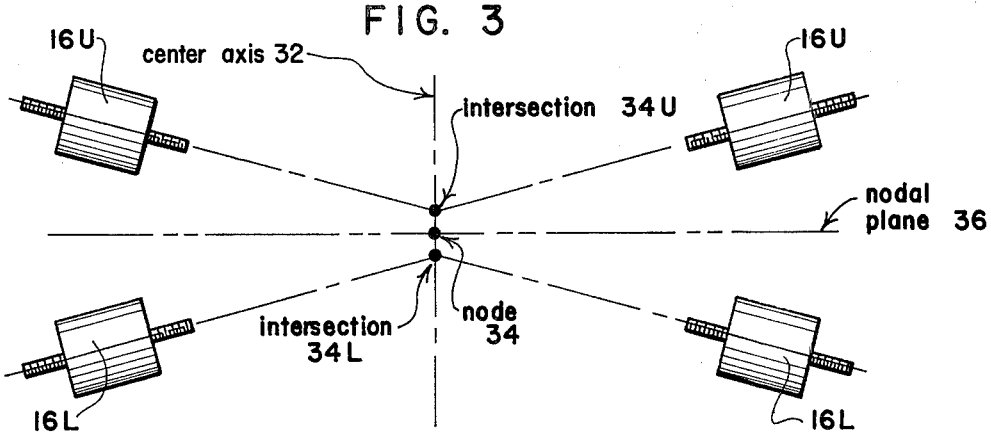

While horizontally-oriented mount axis arrangements of the types shown in FIGS. 1 – 3 are preferred, other less preferred arrangements can be used which incorporate certain principles of the present invention. Referring to FIG. 4, one such arrangement includes inclined upper and lower mounts 16U, 16P having axes intersection points 34U, 34L. This type of mount arrangement is not preferred inasmuch as the mounts 16U, 16L are not loaded solely in shear by the dead weight of the bowl and structure 14 and its contents. Other arrangements of mounts having axis intersection points above and below the node 34 can also be used, together with, or without, still other mounts whose axes intersect the node 34.

As will be apparent from the foregoing description, the present invention provides a novel and improved bowl-type machine of simple construction which is relatively insensitive to variations in bowl loading and which includes a suspension system that greatly enhances null point stability. The principles of this invention can be applied to larger and smaller bowl type machines by using mount arrays which include larger and smaller numbers of elastomeric mounts.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

I claim:

1. A bowl-type vibratory finishing machine, comprising:

a. a base structure;

b. a bowl structure having a central axis and defining a substantially annular chamber adapted to receive finishing media and workpieces to be finished;

c. a plurality of elastomeric mounts movably supporting the bowl structure on the base structure, each of the mounts having one portion secured to the bowl structure and another portion secured to the base structure, the one and another portions defining an axis for each mount;

d. drive means for vibrating the bowl structure relative to the base structure to impart a finishing action to contents of the chamber with the bowl structure moving substantially about a nodal point on the central axis;

e. the elastomeric mounts including a first group of mounts arranged such that their axes intersect at the central axis at a first location on one side of the nodal point, and a second group of mounts arranged such that their axes intersect the central axis at a second location on the other side of the nodal point.

2. The bowl type vibratory finishing machine of claim 1 wherein the elastomeric mounts of one of the groups are arranged with their axes in a common, first horizontal plane.

3. The bowl-type vibratory finishing machine of claim 2 wherein the elastomeric mounts of the other of the groups are arranged with their axes in a common, second horizontal plane.

4. The bowl-type vibratory finishing machine of claim 1 wherein the elastomeric mounts include a third group of mounts arranged such that their axes intersect the central axis substantially at the nodal point.

5. The bowl-type vibratory finishing machine of claim 4 wherein the elastomeric mounts of the third group are arranged with their axes in a common, horizontal plane which includes the nodal point.

6. The bowl-type vibratory finishing machine of claim 1 wherein each group includes at least three mounts.

7. The bowl-type vibratory finishing machine of claim 6 wherein the first and second groups each consist of the same number of mounts.

8. The bowl-type vibratory finishing machine of claim 7 wherein each mount of the first group overlies a separate one of the mounts of the second group.

9. The bowl-type vibratory finishing machine of claim 1 wherein certain of the elastomeric mounts are located at substantially equal distances from the central axis.

10. The bowl-type vibratory finishing machine of claim 1 wherein the distance between the first location and the nodal point equals the distance between the second location and the nodal point.

11. A bowl-type vibratory finishing machine, comprising:

a. a base structure;
b. a bowl structure;
c. first and second groups of elastomeric mounts movably supporting the bowl structure on the base structure;
d. each group of mounts including at least three mounts;
e. each of the mounts having one portion secured to the bowl structure and another portion secured to the base structure, the one and another portions defining an axis for each mount;
f. the mounts of the first group having axes which intersect at a first point;
g. the mounts of the second group having axes which intersect at a second point spaced from the first point; and,
h. drive means for vibrating the bowl structure relative to the base structure substantially about a nodal point located between the first and second points.

12. The bowl-type vibratory finishing machine of claim 11 wherein the nodal point is located substantially equidistant from the first and second points.

13. The bowl-type vibratory finishing machine of claim 11 additionally including a third group of mounts arranged such that their axes intersect substantially at the nodal point.

14. The bowl-type vibratory finishing machine of claim 11 wherein the first and second groups each consist of the same number of mounts.

15. The bowl-type vibratory finishing machine of claim 14 wherein each mount of the first group overlies a separate one of the mounts of the second group.

16. A bowl-type vibratory finishing machine, comprising:

a. a base structure;
b. a bowl structure;
c. drive means for vibrating the bowl structure relative to the base structure substantially about a null point;
d. shear-loaded elastomeric mount means including a plurality of elastomeric mounts for movably supporting the bowl structure on the base structure, the mounts being relatively incompressible and inextensible under the influence of compression and tension forces; and,
e. mounting means arranged and supporting selected ones of the mounts for utilization of the relatively incompressible and inextensible nature thereof to stabilize the location of the null point as the bowl structure vibrates relative to the base structure.

17. The bowl-type vibratory finishing machine of claim 16 wherein each of the mounts has one portion secured to the bowl structure and another portion secured to the base structure, the one and another portions defining an axis for each mount, and the axes of the selected mounts do not intersect the null point.

18. The bowl-type vibratory finishing machine of claim 17 wherein the axes of mounts other than the selected mounts intersect the null point.

19. The bowl-type vibratory finishing machine of claim 17 wherein the selected mounts include first and second groups of mounts, the mounts of the first group having axes which intersect on one side of the null point, and the mounts of the second group having axes which intersect on the other side of the null point.

20. The bowl-type vibratory finishing machine of claim 19 wherein each mount of the first group overlies a separate one of the mounts of the second group.

21. The bowl-type vibratory finishing machine of claim 19 wherein each group includes at least three mounts.

22. The bowl-type vibratory finishing machine of claim 21 wherein the first and second groups each consist of the same number of mounts.

* * * * *